US007976003B2

(12) United States Patent
Kaneko

(10) Patent No.: US 7,976,003 B2
(45) Date of Patent: Jul. 12, 2011

(54) BOOKBINDING APPARATUS AND BOOKBINDING SYSTEM

(75) Inventor: Masahiro Kaneko, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 695 days.

(21) Appl. No.: 12/042,703

(22) Filed: Mar. 5, 2008

(65) Prior Publication Data

US 2009/0081002 A1 Mar. 26, 2009

(30) Foreign Application Priority Data

Sep. 25, 2007 (JP) ..... 2007-246911

(51) Int. Cl.
*B65H 37/04* (2006.01)

(52) U.S. Cl. ..... 270/58.09; 270/58.07; 270/58.08; 412/8; 412/37

(58) Field of Classification Search ..... 270/58.07, 270/58.08, 58.09; 412/8, 33, 37
See application file for complete search history.

(56) References Cited

U.S. PATENT DOCUMENTS

2007/0286705 A1* 12/2007 Sasamoto et al. ..... 412/13
2008/0267735 A1* 10/2008 Hama ..... 412/37

FOREIGN PATENT DOCUMENTS

JP 2006-346984 12/2006

* cited by examiner

*Primary Examiner* — Leslie A Nicholson, III
(74) *Attorney, Agent, or Firm* — Finnegan, Henderson, Farabow, Garrett & Dunner, L.L.P.

(57) ABSTRACT

To form a consistent non-application area at an end of a spine of a sheet bundle by adjusting either an application start timing or application termination timing of adhesive through an application device.

8 Claims, 10 Drawing Sheets

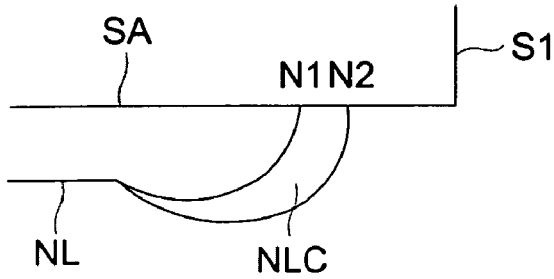
FIG. 9 (a)
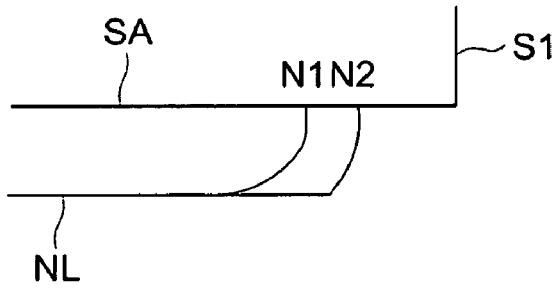
FIG. 9 (b)
FIG. 10
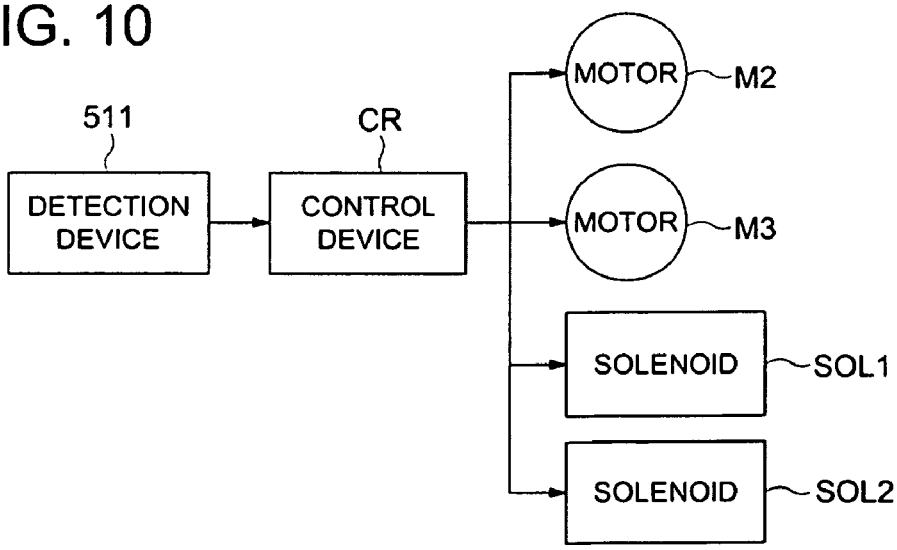

BOOKBINDING APPARATUS AND BOOKBINDING SYSTEM

This application is based on Japanese Patent Application No. 2007-246911 filed on Sep. 25, 2007, in Japanese Patent Office, the entire content of which is hereby incorporated by reference.

BACKGROUND OF THE INVENTION

The present invention relates to a bookbinding apparatus to bind a sheet bundle by applying adhesive and a bookbinding system to bind sheets by applying adhesive after forming images on the sheets.

Bookbinding apparatuses to bind the sheet bundle made up of a plurality of sheets by applying adhesive where adhesive is applied by moving an application device along a spine of the sheet bundle have been developed as compact bookbinding apparatus.

They have been developed as the compact bookbinding apparatuses used particularly in bookbinding systems where an image forming process to form an image on a sheet through an image forming apparatus and a bookbinding process to bind sheets are carried out integrally.

For example, in Unexamined Japanese Patent Application Publication No. 2006-346984, there is suggested a bookbinding apparatus where the application device is moved along the spin of the sheets for application to carries out a first application operation where the application device is in contact with the sheet bundle with a high contact pressure to carry out application and a second application operation to carry out application with a low contact pressure.

In the bookbinding apparatus of Unexamined Japanese Patent Application Publication No. 2006-346984, the first and second application operations are performed for a purpose of ensuring adhesion between the sheets configuring the sheet bundle as well as adhesion of a front sheet.

Patent document 1: Unexamined Japanese Patent Application Publication No. 2006-346984

SUMMARY OF THE INVENTION

A cross-sectional structure of an adhesive portion of the spine of the sheet bundle to which adhesive is applied by moving the application device along the spine of the sheet bundle is as shown in FIG. 8(*a*).

As FIG. 8(*a*) shows, when an adhesive layer NL is formed on the spine SA of the sheet bundle S1, the adhesive protrudes from both ends of the spine SA such as NLA and NLB.

These protrusions NLA and NLB not only deteriorate finishing quality of booklets also easily adhere to various portions of the bookbinding apparatus, the sheet or a front sheet attached to the sheet and cause a failure in execution of processes.

In order to prevent, these protrusions, as FIG. 8(*b*) shows, a method where the adhesive layer NL is formed with leaving ends of the spine to be non-application portions SA1 and SA2 at the ends of the spine SA is considered. However, since lengths of non-application portions SA1 and SA2 (length in a direction along the spine SA) vary and in case the thickness of the sheet bundle is thick, lengths of non-application portions SA1 and SA2 become short and a phenomenon shown in FIG. 8(*a*) occurs.

Such a problem does not occur if the lengths of the non-application areas SA1 and SA2 are elongated equally, however in this way, there is occurred problems that large non-application areas are formed at the ends which results incomplete binding, thus a binding strength is deteriorated.

An aspect of the present invention is as follows.

1. A bookbinding apparatus, having; an application device to apply adhesive on a spine of a sheet bundle; a first driving device to relatively move the sheet bundle or the application device in a first direction along a longitudinal direction of the spine of the sheet bundle; a second driving device to relatively move the sheet bundle or the application device to a close position being close the application device to the spine of the sheet bundle and a receding position being separate the application device from the spine of the sheet bundle; a thickness information creation device to create thickness information of the sheet bundle; and a control device to control the first driving device and the second driving device; wherein the control device executes any one of operations where after relatively moving the sheet bundle or the application device in the receding position in the first direction, by relatively moving the sheet bundle or the application device to the close position, and by relatively moving the sheet bundle or the application device in the first direction, the control device controls an application start timing in a way that an application area and a non application area subsequent to the application area are formed on the spine of the sheet bundle, or after relatively moving the sheet bundle or the application device which relatively move in the first direction in the close position to the receding position, by relatively moving the sheet bundle or the application device in the first direction, the control device controls an application termination timing in a way that the application area and the non application area subsequent to the application area are formed on the spine of the sheet bundle, and the control device adjusts either the application start timing or the application termination timing based on the thickness information of the sheet bundle created by the thickness information creation device.

2. A bookbinding system, having; an image forming apparatus to form an image on a sheet; and the bookbinding apparatus of above-mentioned 1 to bind the sheets received from the image forming apparatus.

BRIEF DESCRIPTION OF THE DRAWINGS

FIG. 9(*a*) and FIG. 9(*b*) are drawings showing adhering stats of adhesive at an edge portion of a spine of a sheet bundle.

FIG. 10 is a block diagram of a control system to carry out application control.

DETAILED DESCRIPTION OF THE PREFERRED EMBODIMENT

The following describes the present invention with reference to embodiments, without the present invention being restricted thereto. <Image forming apparatus A>

Figure 1:
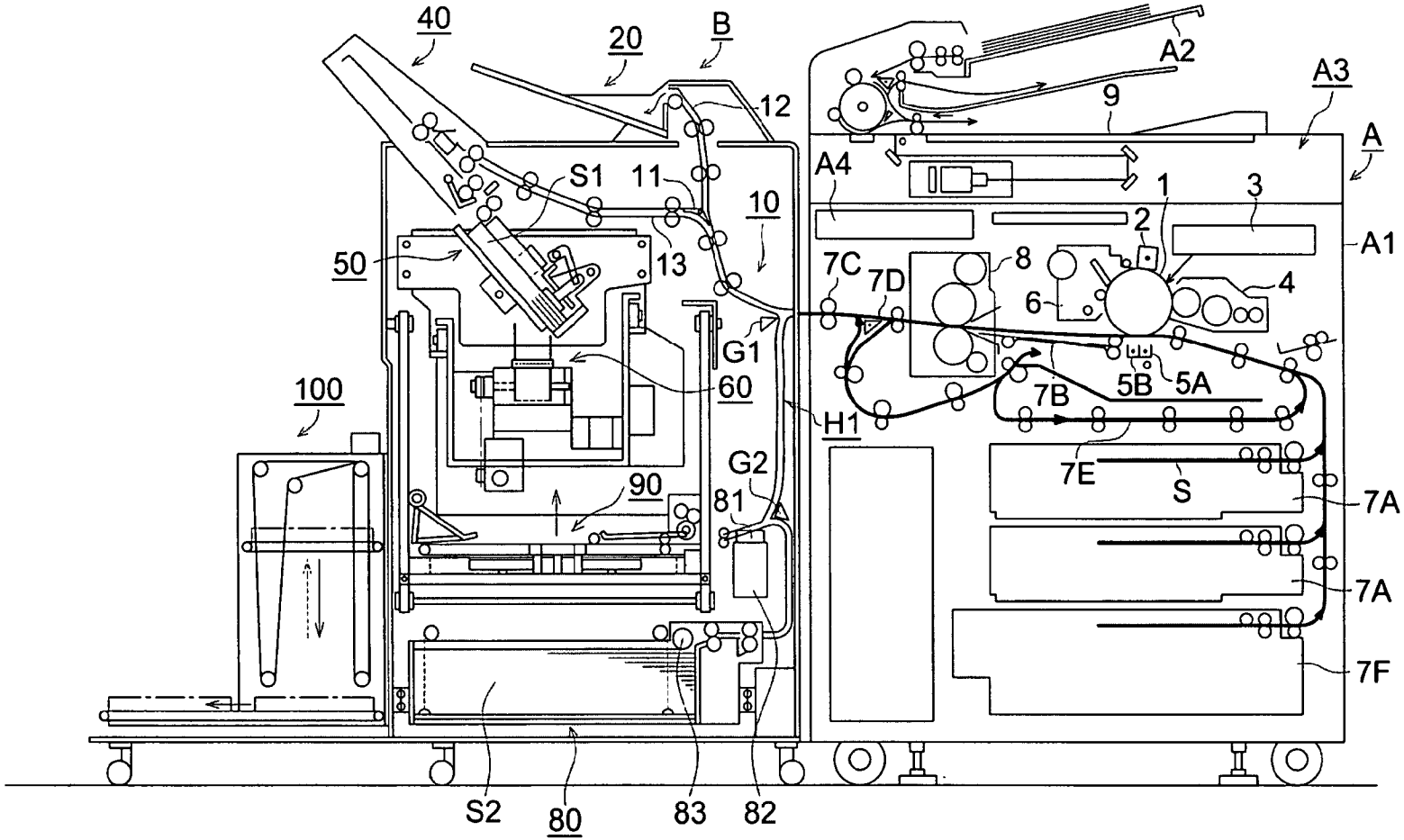
FIG. 1 is an overall structural view of a bookbinding system related to an embodiment of the present invention.

FIG. 1 is an overall structural view of a bookbinding system equipped with an image forming apparatus A and a bookbinding apparatus B.

The image forming apparatus A has an image recording device where a charging device 2, exposing device 3, developing device 4, transferring device 5A, discharging device 5B and cleaning device 6 are arranged at a periphery of an image carrier 1 to rotate. In the image recording device, after the charging device 2 charges a surface of the image carrier 1 evenly, exposing scanning is carried out based on image data read from a document through a laser beam of the exposing device 3 or from outside to form a latent image and a toner image is formed on the surface of the image carrier 1 through the developing device 4 by developing the latent image reversely.

Meanwhile, in the following description, the sheet configuring a booklet is denoted by a sheet S, the sheet bundle is denoted by a sheet bundle 1, the front sheet is denoted by a front sheet S2 and the booklet where the front sheet is bound to the sheet is denoted by a booklet S3.

A paper storing section is equipped with a sheet string section 7A to store the sheet S and a front sheet storing section 7F capable of storing the front sheet S2. The sheet S fed from the sheet storing section is sent to a transferring position. At the transferring position, the toner image is transferred onto the sheet S through the transferring device 5A. After that, a reverse surface of the sheet S is discharged by discharging device 5B and the sheet S is removed from the image carrier 1 then conveyed through a conveyance section 7B, subsequently fixed by heat through a fixing device, and thereafter ejected through sheet ejection rollers 7C.

In case image forming is carried out on both sides of the sheet S, the sheet S after having heat a fixing process through the fixing deice 8, is diverged from an ordinary path by a conveyance path switching plate 7D.

After diverging, the sheet S switchbacks to be turned over through an inversing conveyance section 7E, the sheet s again goes through the image forming section to form an image on the reverse side of the sheet S, then through the fixing device 8 the sheet S is ejected outside from the sheet ejection rollers 7C. The sheet S ejected from the sheet ejection rollers 7C is conveyed to the bookbinding apparatus B.

In case an image is formed on the front sheet S2, the front sheet S2 after having the heat fixing process through the fixing device 8 is diverged from the ordinary sheet ejection path by the conveyance path switching plate 7D, then after diverging, the front sheet S2 is conveyed towards the sheet ejection rollers 7C by replacing a leading edge with a trailing edge, by reversing a rotation direction of the conveyance rollers grasping the front sheet S2, then ejected outside from the sheet ejection rollers 7C.

A document conveyance apparatus A2 conveys documents to a reading position one by one. An image reading section A3 reads an image of a document conveyed through the document conveyance apparatus A2 or a document placed on a document table 9 to create an image signal. A communication section A4 conducts communication with network devices by which an image forming command transmitted from a network is received and an image signal representing image information is created.

A surface of the image carrier after image processing is cleaned through the cleaning device 6 to remove developing agent remaining on the surface so as to be ready for subsequent image forming.

<Bookbinding Apparatus B>

Figure 2:
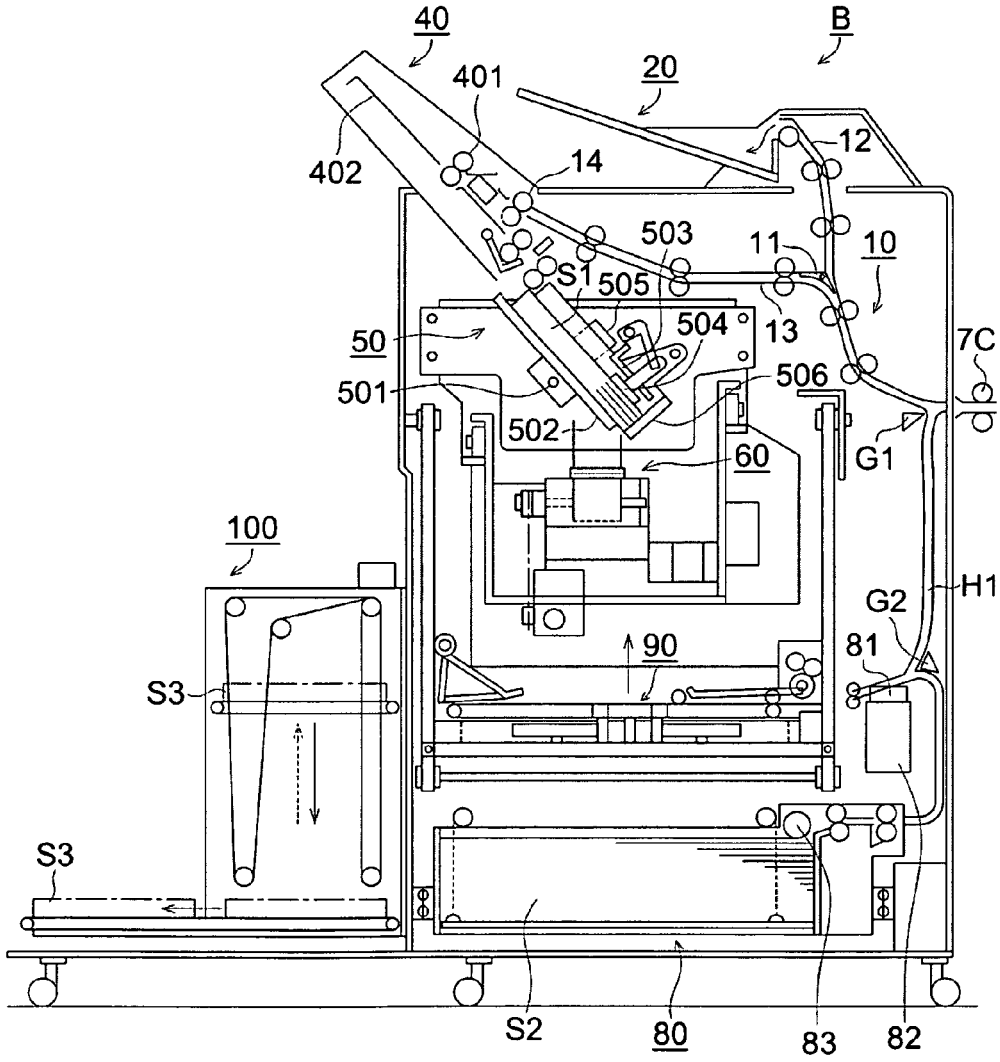
FIG. 2 is a cross-sectional view related to an embodiment of the present invention.

FIG. 2 is a schematic cross-sectional front view of the bookbinding apparatus B.

The bookbinding apparatus B is equipped with a conveyance section 10 to convey the sheet S dejected from the image forming apparatus A to an ejected sheet tray 20 or to a sheet reversal section 40, an accumulation section So to accumulate the sheet S fed from the sheet reversal section 40 one by one, application deice 60, a front sheet storing section 80 representing a second front sheet storing section to store the front sheet S2, a sheet feeding roller 83 to feed the front sheet S2, a cutting device 81 to cut the front sheet S2 in a length corresponding to the bundle of the sheet S, a front sheet supporting section 90 to support the front sheet S2 and a booklet ejection section 100.

The conveyance path switching gate G1 changes conveyance paths of the sheet S ejected from the image forming apparatus A or the front sheet S2.

In case a sheet ejected from the image forming apparatus A is the sheet S, the sheet s is sent to conveyance section 10 through the conveyance path switching gate G1, then through a switching gate 11 provided in a middle of conveyance section 10, the sheet s is ejected to the sheet ejection try 20 via an ejection path 12 or conveyed to the sheet reversal section 40. In case bookbinding is not assigned through operation section, the sheet S is ejected to the sheet ejection tray 20.

In case the sheet ejected from the image forming apparatus A is the front Sheet S2, the front sheet S2 is conveyed to conveyance section H1 through the conveyance path switching gate G1. Further, through a switching gate G2 which switches the front sheet S2 sent from the front sheet storing section 80, the sheet S2 is sent to the front sheet supporting section 90 via a cutter 81.

In case bookbinding is assigned through the operation section (bookbinding process mode), the sheet S is conveyed via the conveyance path 13 to the sheet reversal section 40 and after switchback at the sheet reversal section 40, the sheet S is conveyed to the accumulation section 50. In the accumulation section 50, a predetermined number of the sheets S are accumulated, and when the predetermined number of the sheets S are accumulated, the accumulation section 50 grasps and turns the bundle of the sheets S and then hold it substantially vertically.

The application device 60 applies adhesive on the spine of the sheet bundle S1 (lower surface in FIG. 2) which is being held by the accumulation section 50 substantially vertically. The front sheet S2 comes in contact with and adheres to the sheet bundle S1 on which the adhesive is applied so as to form a booklet S3. The booklet is ejected to a booklet ejection section 100.

The following is a description of each portion of the bookbinding apparatus.

The sheet S conveyed through the conveyance path 13 is ejected by ejection rollers 14 and conveyed through swing pressure rollers 401 and rises along an oblique reversal tray 402 then the swing pressure rollers 401 rotate reversely to convey the sheet S downward. The sheet S conveyed downward falls onto the accumulation section 50.

In the accumulation section 50, the sheet S fallen from the sheet reversal section 40 is supported in a oblique state by the sheet supporting device configured with a supporting plate 502 and a receiving plate 506.

The sheets S subsequently ejected from the image forming apparatus are accumulated in the accumulation section 50 so as to form the sheet bundle S1. The number of sheets S configuring the sheet bundle is recognized from the number of the document counted through an automatic document conveyance device equipped at the image forming apparatus, the number of document obtained from document image information transmitted via personal computer or the number of document inputted by an operator in advance.

A numeral 504 denotes a member to prevent unseated sheets S, by being detached from and attached to the sheet S every time a piece of the sheet S is supplied to the accumulation section 50 so as to hold the sheet S. A numeral 505 denotes an alignment plate to align a side edge of the sheet.

At a stage where the predetermined number of the sheets S is accumulated in the accumulation section 50, a holding plate 503 operates to grasp and hold the sheet bundle S1.

In the state where the sheet bundle S1 is being grasped and held, the accumulation section 50 revolves about an axis 501 to make the sheet bundle S1 in a vertical state from an oblique state.

<Application Preparing Process>

Figure 3:
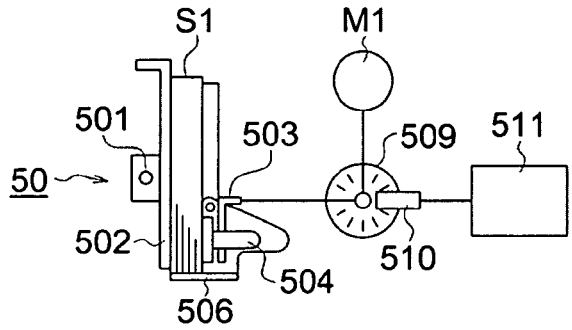
FIG. 3(*a*) and FIG. 3(*b*) are drawings showing preparation processes of application.
Figure 3:
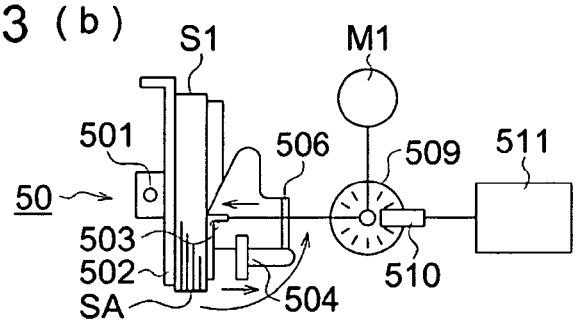

FIG. 3 shows an application preparing process where the sheet bundle S1 is held in the vertical state in the accumulation section 50 to enable application of adhesive.

Before describing the application process, holding of the sheet by holding plate 503 will be described with reference to FIG. 3(*a*).

The holding plate 503 is driven and moved by a motor M1, to press the sheet bundle S1 and stop by detecting that a drive torque for pressing reaches a predetermined value, thereby the sheet bundle S1 is held by a supporting plat 502 and the holding plate 503. A stop position of the holding plate 503 is detected by an encoder and memorized in a memory device of a position detection device 511 as information to indicate a thickness of the sheet bundle S1.

In a state where the sheet bundle S1 is held, as FIG. 3(*b*) shows, the receiving plate 506 turns 90 to be retracted.

<Application Process>

The application device 60 has an application roller 61 and an adhesive container 63 to contain adhesive N composed of hot melt adhesive.

A symbol HT1 denotes a heater provided on a bottom section of the adhesive container 63 and a symbol HT2 denotes a heater provided in the application roller 61. The hot melt adhesive supplied in a solid form goes into a liquid form by heat of the heater HT1 and fills the adhesive container 63.

Numerals 603 and 604 denote regulation members to regulate an application amount and to make the application layer even, a symbol TN denotes a temperature sensor, and a numeral 606 denotes a remaining amount sensor to detect a remaining amount of the adhesive.

The adhesive container 63 capable of rotating around an axis 63A can be set in a state shown by a solid line and in a state shown by broken lines.

The regulation member 603 is a member in a shape of a round bar.

The regulation member 604 has a main scraping section 604A and a sub-scraping section 604C which is slightly lower than the main scraping section 604A.

Further, at a lower section, the regulation member 604 has a regulation section 604D to regulate the thickness of a adhesive layer on the application roller 61.

Figure 5:
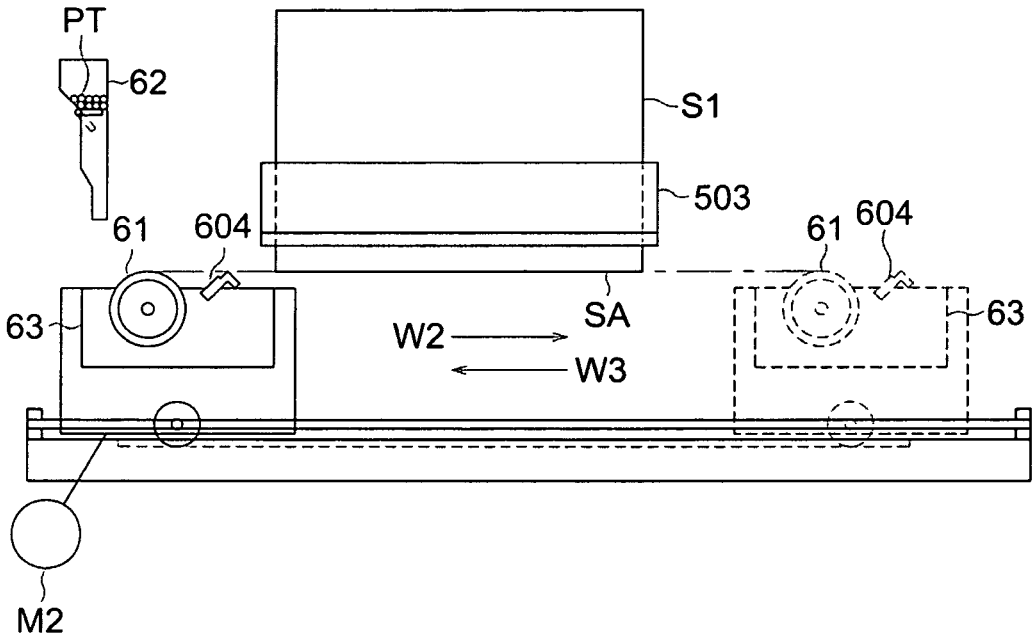
FIG. 5 is a drawing showing an application process.

In a process where the adhesive N is applied on the spine of the sheet bundle S1, the motor M2 moves the application device 60 from a home position shown by a solid line in FIG. 5 to a turn-around position on a right end shown by broken lines in a direction W2 and application is carried out on an outward travel.

Next, application is carried out on a homeward travel by moving the application device 60 from the turn-around position to a home position in a direction W3.

As above, application process for the sheet bundle S1 is executed in the outward travel and the homeward travel of the application device 60.

The motor M2 is a first driving device to move the application device 60 in the first directions W2 and W3.

Meanwhile, a numeral in FIG. 5 denotes an adhesive supplying section and solid adhesive PT in a shape of pellets stored in the adhesive supplying section is supplied to the application device 60 parking in the home position.

In the embodiment shown by the figure, while the application device 60 moves in the first direction along the spine SA of the sheet, the sheet bundle and the application device 60 have only to move relatively. Thus, the sheet bundle S1 may be moved to carry out application.

Details of application operation will be described with reference to FIG. 4 to FIG. 7.

Figure 6:
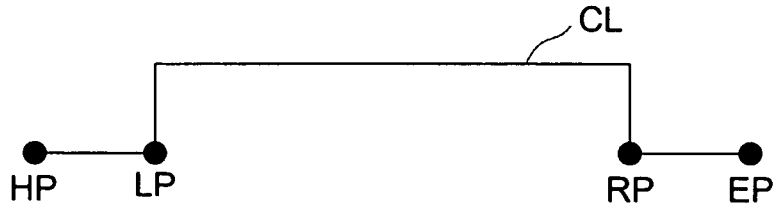
FIG. 6 is a drawing showing movement of an application device in an application process.

In FIG. 6, a symbol HP denotes the home position, in a relative moving direction of the application device 60 in respect to the sheet bundle, located at the back side of the apparatus, and a symbol EP denotes the turn-around position located at front side of the apparatus.

A curve line CL in FIG. 6 shows a relative vertical position in respect to the sheet bundle in the application process.

Figure 7:
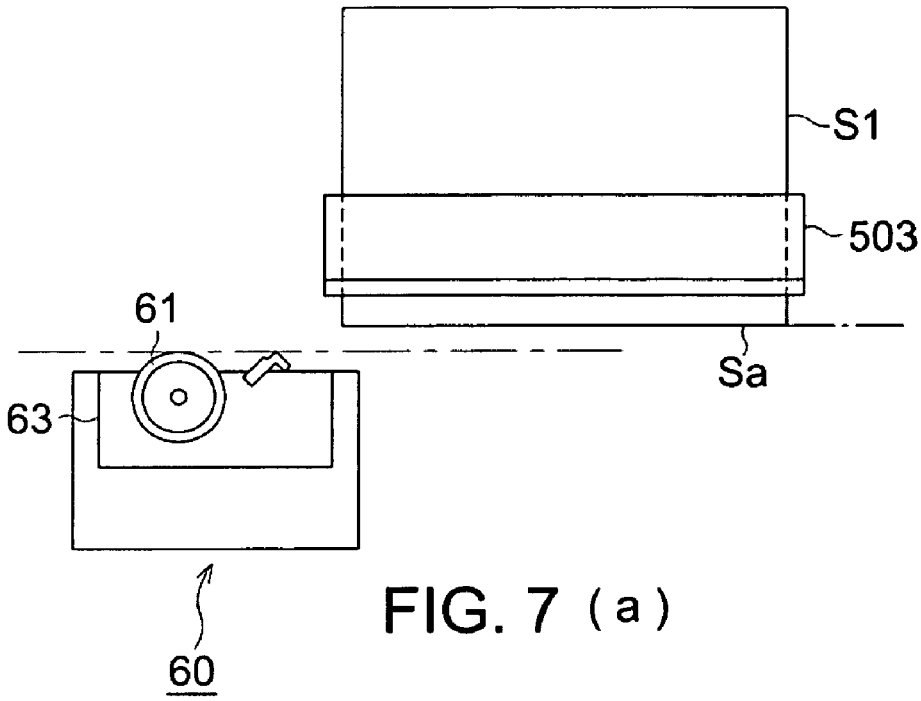
FIG. 7(*a*) and FIG. 7(*b*) are drawings showing a vertical position of an application device.
Figure 7:
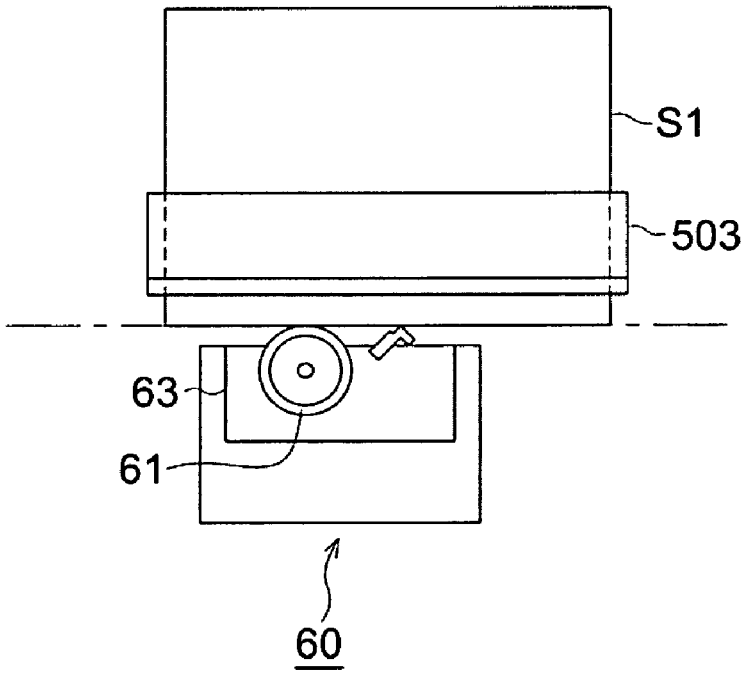

In the home position HP, as FIG. 7(*a*) shows, the application device 60 is relatively lower than the sheet bundle, and the application roller 61 is detached from the spine SA of the sheet bundle S1. Vertical movement of the application device 60 shown in FIG. 7(*a*) and FIG. 7(*b*) is executed by on/off operation of a solenoid SOL1 shown in FIG. 4.

The solenoid SOL1, located in the application device, is a second driving device to move the application device 60 between positions close to and distant from the spine SA in a second direction.

At a left end position LP representing an application start position of the outward travel, the application device 60 rises to a position of FIG. 7(*b*) and the application roller 61 comes in contact with the spine SA of the sheet bundle S1, then the application device 60 moves from the left end position LP to a right end position RP.

When this occurs, the application roller 61 rotates in an anticlockwise direction of the direction W1 by driving the motor M3 to apply the adhesive N on the spine SA.

At the right end position RP, the application device 60 comes down to a position of FIG. 7(*a*) relatively in respect to the sheet bundle to terminate application on the outward travel.

Next, the application device 60 moves from the turn-around position EP in the direction W3, and rises to the position of FIG. 7(*b*) at the right end position RP, then moves to the left end position LP. In this movement, the application roller 61 rotates in the direction W1 to apply the adhesive N onto the spine SA.

At the left end position LP, the application device 60 comes down and the adhesive surface of the application roller 61 is detached from the spine SA and application on the homeward travel terminates.

In application of the outward travel where the application device 60 moves in the direction W2 to apply, the regulation member 603 operates to make the adhesive layer NL on the spine of the sheet bundle uniform.

Also, in application of the homeward travel where the application device 60 moves in the direction W3 to apply, the regulation member 604 operates to make the adhesive layer NL uniform.

Figure 4:
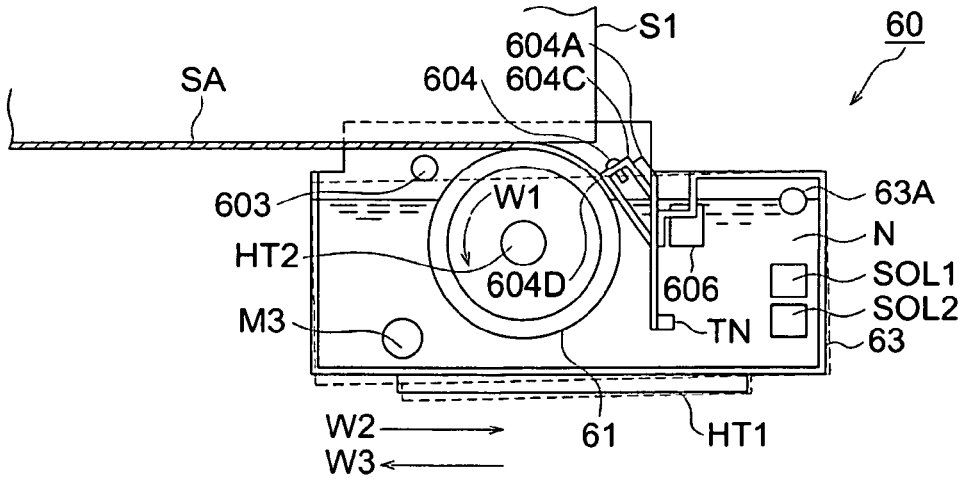
FIG. 4 is a drawing showing an application device.

As above, since the regulation members 603 and 604 moves alternately on the outward and homeward travel, the application device 60 supported rotatably by the axis 63A carries out application of the outward travel in a state shown by a solid line in FIG. 4, and the regulation member 603 makes the adhesive layer NL formed on the spine SA of the sheet bundle S1 uniform.

In application of the homeward travel, the application device 60 is set at a position shown by the broken lines of FIG. 4 to carry out application.

In this case, the regulation member 604 makes the adhesive layer NL formed on the spine SA even.

Ascent and descent of the application device 60 at left and right end positions LP and RP is caused by the solenoid SOL1 provided in the application device 60. Also, rotation of the adhesive container 63 in FIG. 4 shown by the solid line and the broken lines is caused by the solenoid SOL2 provided in the application device 60.

Figure 8:
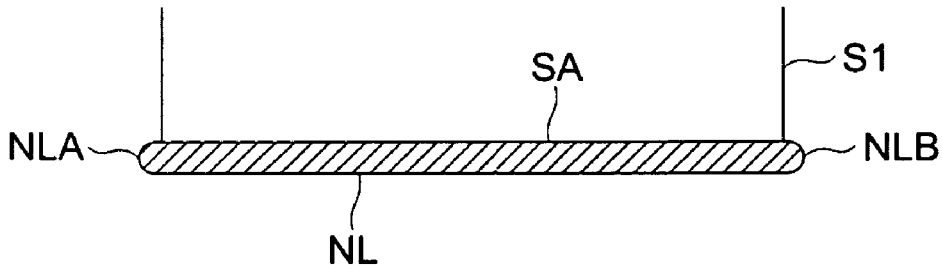
FIG. 8(*a*) and FIG. 8(*b*) are drawings showing application stats of adhesive.
Figure 8:
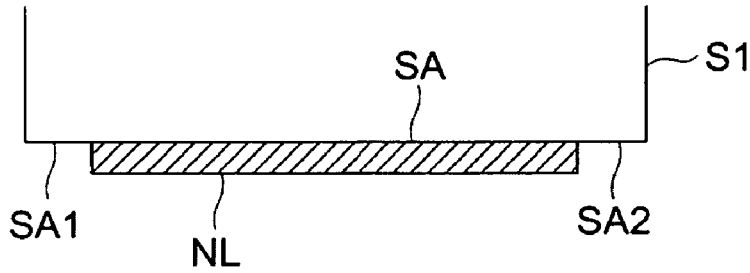

By controlling the application device 60 shown in FIG. 6, at a beginning of application, an application area is formed after a non-application area and at an ending of application area, a non-application area is formed after the application area respectively as FIG. 8(*b*) shows.

<Application Control>

As FIG. 8(*a*) shows, when the adhesive layer NL is formed on the whole length of the spine SA, as symbols NLA and NLB show, a phenomenon that an end of the adhesive layer NL protrudes from the end of the sheet bundle S1 is likely to occur.

As a result, an apparent quality is deteriorated, further when the booklets are stored, they are irregularly stored each other, thus a storage capacity is deteriorated.

Further, in a bonding process of the front sheet S2, there is caused a defect that the protruding portions NLA and NLB adhere unintended portions such as various portions of the apparatus, the sheet bundle S1 and the front sheet.

Therefore, in the embodiment of the present invention, as FIG. 8(*b*) shows, application is carried out in a way that the application area where the adhesive layer NL is formed at a center section and the non-application sections SA1 and SA2 where the adhesive layer is not formed are formed at both end sections.

Meanwhile, depending on a usage of the booklet, only one of the non-application areas SA1 or SA2 is formed and the non-application area is not formed on the other side.

Non-application areas SA1 and SA2 are formed with controlling left and right end positions LP and RP in FIG. 6.

Namely, Non-application areas SA1 and SA2 are formed by controlling on/off timings of the solenoid SOL1 to conduct ascent and descent of the application device 60.

Lengths of non-application areas SA1 and SA2 are preferred to be some millimeters.

In a beginning of application at left and right end positions LP and RP of FIG. 6, particularly in a beginning of application at the right position RP on the homeward travel, depending on the rotation direction of the application roller 61, the length of the non-application area varies with the thickness of the sheet bundle S1.

At the application start position RP, the adhesive layer NL rises at end position as NLC shows in FIG. 9(*a*).

After that, the regulation member makes the adhesive layer NL uniform as FIG. 9(*b*) shows.

At the end section, given that N1, as a designed value, is an end position of the adhesive layer NL, if the sheet bundle S1 is thick and a large amount of adhesive is applied, the amount of adhesive shown by NLC increases, then the end position of the adhesive layer NL moves to an end side of the spine SA as N2 to shorten the non-application area SA2.

If it is enormous, as NLA and NLB in FIG. 8, the adhesive protrudes from the sheet bundle S1 and causes a defect that the quality of the booklet is deteriorated.

The above protrusion of the adhesive tends to occur in the beginning (a beginning of application at the end position RP in FIG. 6) of application where the rotation direction of the application roller 61 at an application position to apply adhesive on the spine SA of the sheet bundle and the moving direction of the application device 60 shown by W3 are the same. Namely, the adhesive supplied to the spine SA of the sheet bundle S1 form the application roller 61 is accumulated on the right side of the application start position, on the other hand since the application device 60 moves in the direction of W3, the adhesive accumulated at right side of the application start position cannot escape to a left side of the application start position therefore spreading at the end side of the spine SA.

However, the above problem occurs not only at the beginning of application which is affected by the relation between the rotation direction of the application roller 61 and the moving direction of the application device 60, but at the beginning of application of the outward travel (beginning of application at the left end position LP in FIG. 6) and the end of application of the outward and homeward travels (end of application at left and right end positions LP and RP in FIG. 6) to some extend.

The above phenomenon becomes pronounced in case the thickness of the sheet bundle S1 is thick. Namely, it is presumed that if the sheet bundle S1 becomes thick, a contact area between the spine SA and the adhesive on the application roller 61 becomes large, thereby such a phenomenon becomes pronounced.

In the embodiment of the present invention, by adjusting the left and right end positions LP and RP in FIG. 6 in accordance with the thickness of the sheet bundle S1, the above problem is solved.

As above, application control to control the left and right end positions LP and RP in accordance with the thickness of the sheet bundle S1 is carried out in various embodiments to suite usage of the booklet or characteristics of the adhesive as follow.

(1) Application Control 1

Next, the above application control is described as follow.

FIG. 10 is a block diagram of a control system to carry out application control.

In FIG. 10, a control device CR controls a motor M2 representing a first drive device, and moves the application device 60 in a direction of arrows W2 and W3 in FIG. 5 horizontally and then controls a motor M3 to rotate the application roller 61 in a single direction to apply adhesive, then controls the solenoid SOL1 representing a second drive device to ascend and descend the application device 60 as a curve CL shows in FIG. 6. The control device CR also controls the solenoid SOL2 to revolve the adhesive container 63 to positions shown by a solid line and broken lines.

As described below, the control device CR controls the positions shown by LP and RP in FIG. 6 based on information of the thickness of the sheet bundle S1 which is created by a position detection device 511 representing a thickness information creation device.

Meanwhile, as the thickness information, besides a measurement result of the thickness of the sheet bundle S1, information which an operator inputs through the thickness information creation device such as an operation section (unillustrated) or information obtained by calculation using a thickness of one piece of the sheet and number of sheets counted can be accepted.

Figure 11:
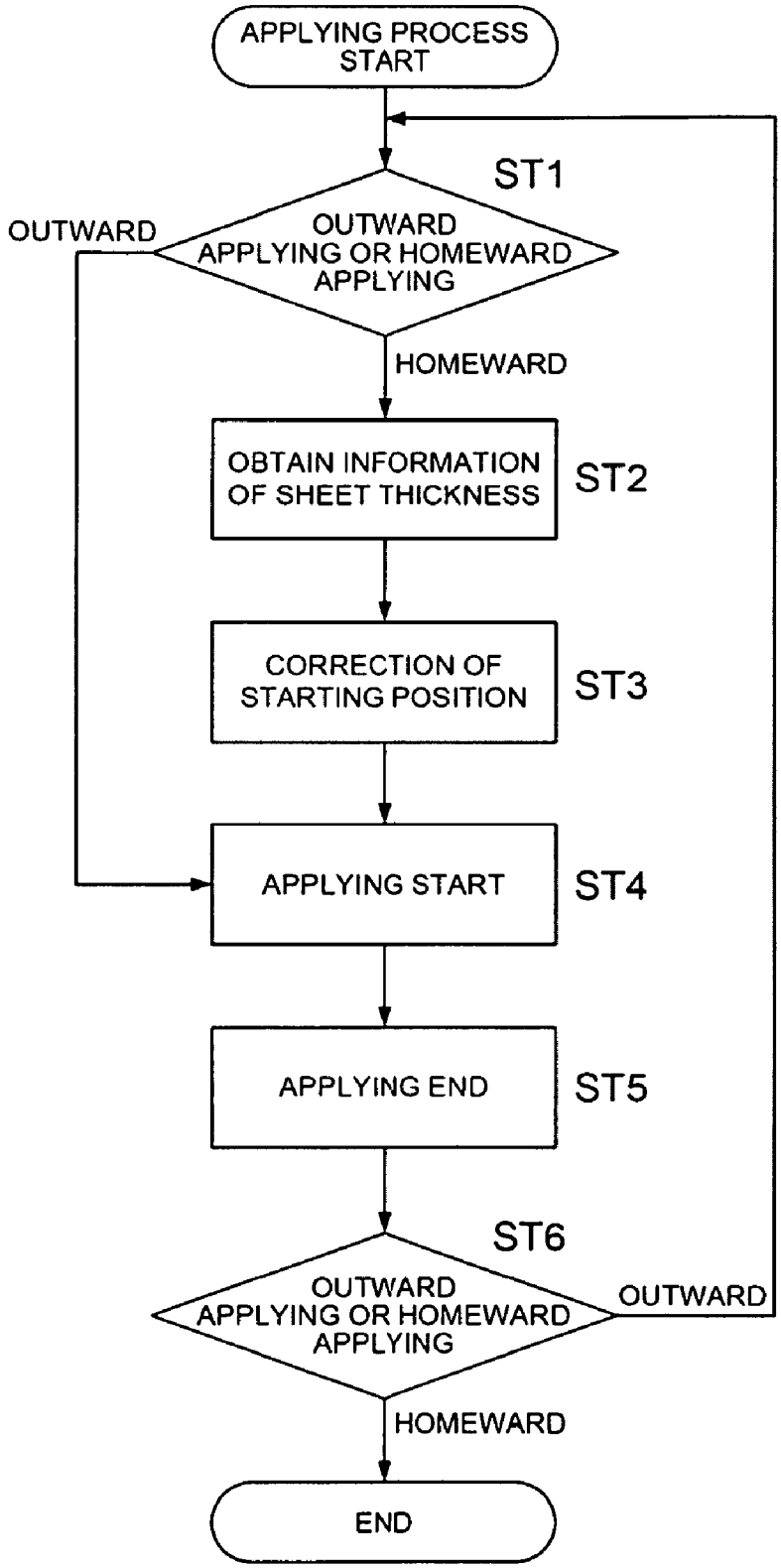
FIG. 11 is a flow chart of a first example of application control.
Figure 12:
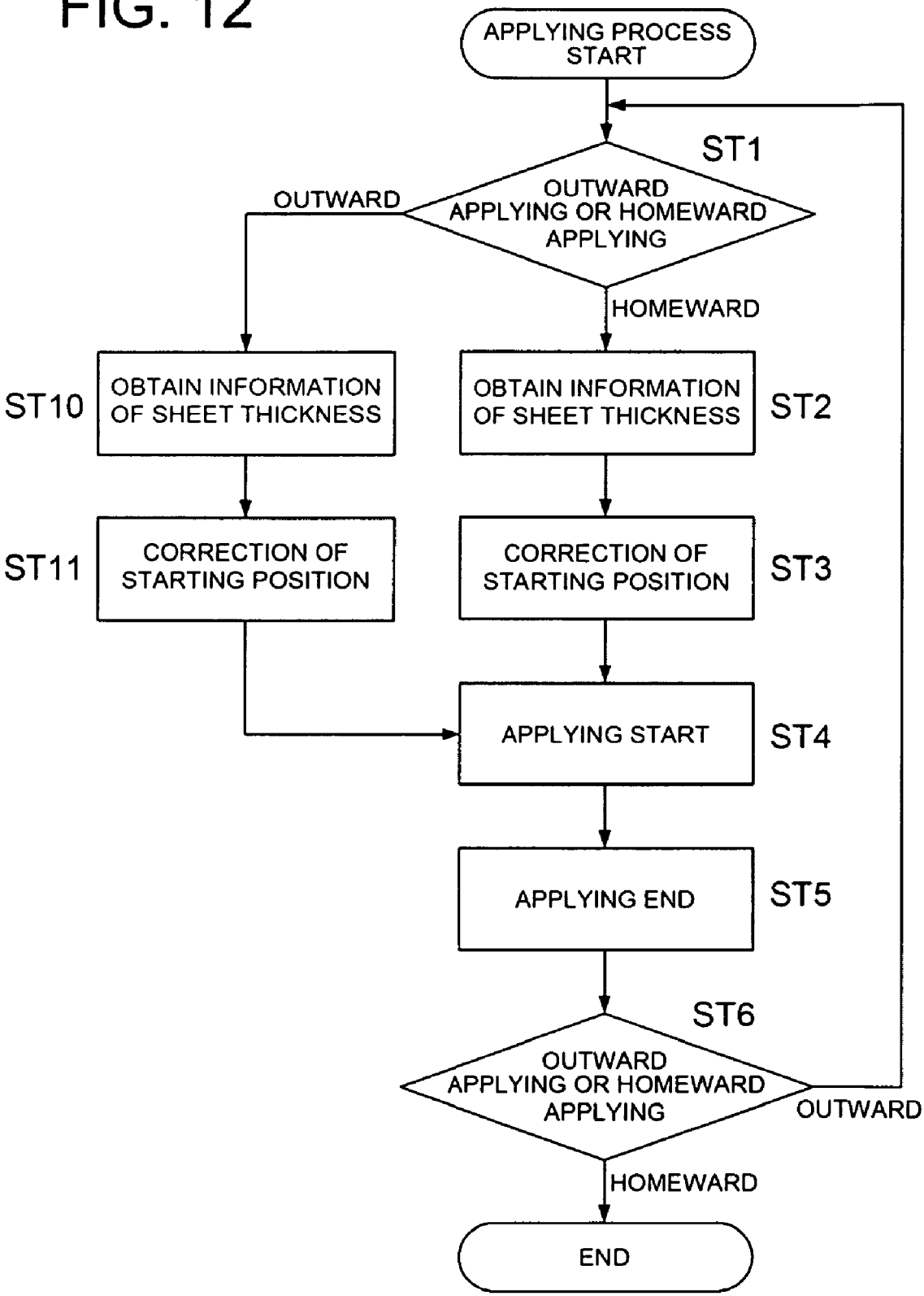
FIG. 12 is a flow chart of a second example of application control.

FIG. 11 shows an example to control the application start position RP (refer to FIG. 6) of the homeward travel.

After the application process starts, in step ST1, whether it is starting of application of the outward travel or the homeward travel is verified.

The control device CR has a timer. The timer starts when application starts. Time control described later is carried out based on the time measurement of the timer.

For application start of the outward travel (ST1 outward), at step ST4, the application device 60 moves in the direction W2, and ascends at the left position PL which is set by default to perform application.

In this case, the application device 60 locates at the left end position LP, and a timing for ascend is a default timing, then when the measurement time of the timer reaches the default timing, the application starts.

If the homeward travel (homeward in Step ST1) is selected in step ST1, thickness data of the sheet bundle S1 is read in step ST2.

The thickness data is obtained at a position of the holding plate 503 in FIG. 3(*a*) and read out from the position detection device 511.

Meanwhile, the thickness data can be obtained by calculating the number of the sheet configuring the sheet bundle S1 and a thickness of the sheet.

In step ST3, the ascent timing of the application device 60, namely start timing of the solenoid SOL1 at the left position LP, is corrected based on the thickness.

For example, in case a thick sheet bundle, the default timing is corrected by some hundred m seconds to retard the timing.

In step ST4, the solenoid SOL1 is operated to ascend the application device 60 and application is carried out.

In step ST5, the solenoid SOL1 is turned off to descent the application device 60 and the application roller 61 is detached from the spine SA to terminate application.

In step 6, whether the application device is on the outward or homeward travel is judged, and if it is on the outward travel, the procedure returns to step ST1.

The next application after returning to step ST1 is to be application of homeward travel, therefore judgment in step 1 is "homeward" application control described in the foregoing will be carried out.

In the present embodiment, the timer of the control device CR starts time measurement when the application process starts.

After the application process starts, in step ST1, whether the start of application is of the outward travel or homeward travel is verified.

At the start of application of the outward travel, in step ST10, the thickness information of the sheet bundle S1 is obtained, then in step ST11, the application start position is corrected based on the information obtained.

Following step ST11, processes after step ST4 are as a description regarding FIG. 11 in the foregoing. In step ST6, if the application is judged to be application of the outward travel, in the step ST1, application of homeward travel is carried out in accordance with description in the foregoing.

It is preferred that a correction value of start position correction in step ST3 and a correction value of start position correction in step ST1 differ each other to be appropriate values.

Namely, a deviation amount of the adhesive end position at left position LP and a deviation amount of the adhesive end position at right position RP in FIG. 6 tend to be different.

At end of application, the application roller 61 is detached from the spine SA, in this case, a hump NLC in FIG. 9 is created and an amount of the hump differs with the thickness of the sheet S1.

Figure 13:
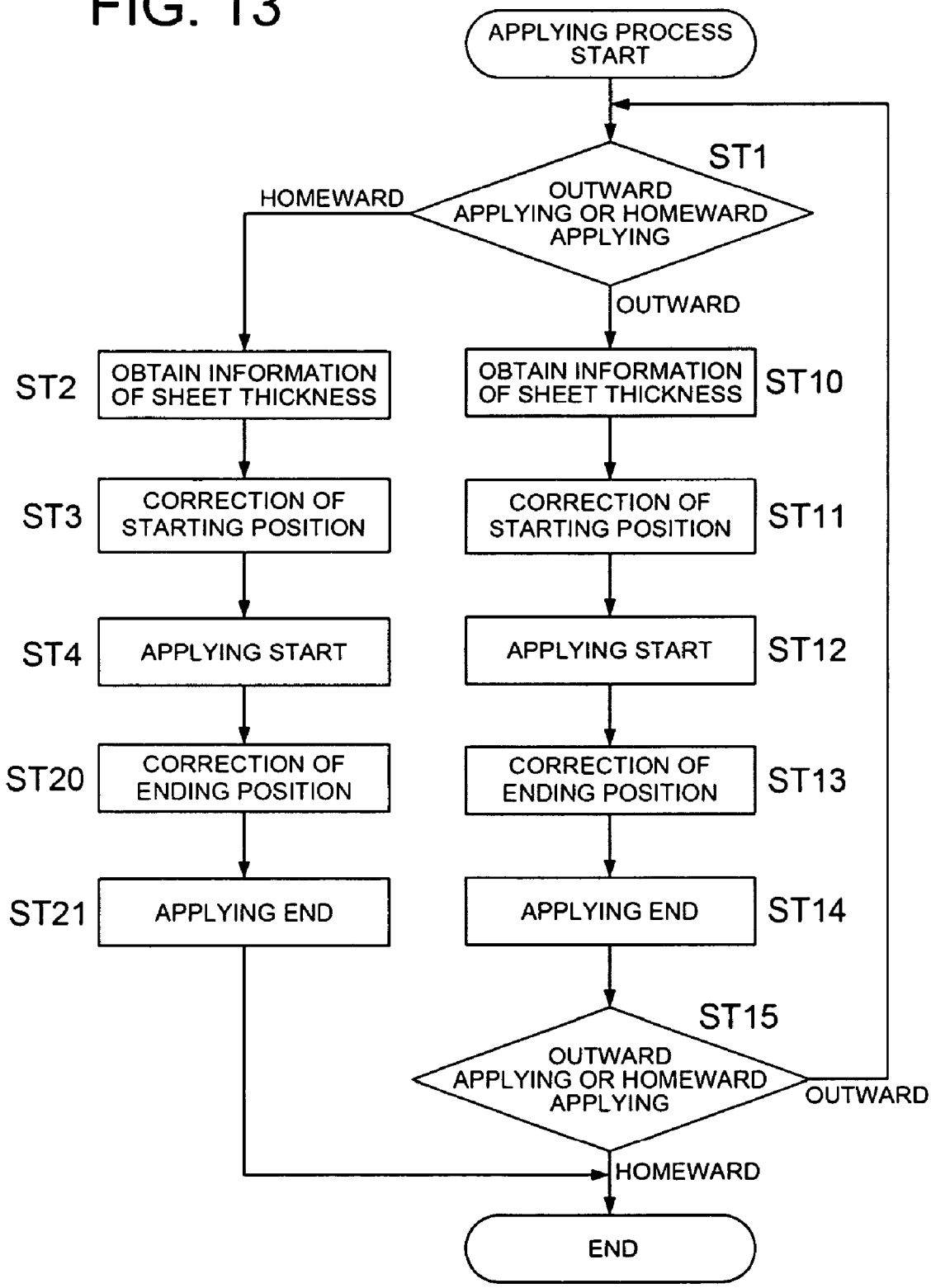
FIG. 13 is a flow chart of a third example of application control.

FIG. 13 shows application control where a countermeasure for such phenomenon is taken. In the present exemplary control, the timer of the control device CR starts time measurement at start of application process.

After judging whether it is outward travel application or homeward travel application in step ST1, procedures of step ST10 to step ST12 are the same as that of step ST2 to step ST4 in FIG. 11.

In step ST13, the application termination position is corrected. This correction is carried out based on the information of the sheet bundle S1 obtained in step ST10. As the sheet bundle S1 becomes thick, the termination position is advanced so as to prevent the non-application area from shortening.

In step ST14, the solenoid SOL1 is turned off at the corrected end position to descent the application device 60 to terminate application.

After application terminates, in step ST15, whether it is outward travel application or homeward travel application is judged and if it is homeward travel application, operation terminates. If it is outward travel application, at step ST1, whether subsequent application is outward travel application or homeward travel application is judged.

Procedures in step ST2 to step ST4 are the same as that in step ST2 to step ST4 in FIG. 11.

In step ST20 followed by step ST4, the end position is corrected based on the thickness of the sheet bundle S1, then in step ST21, the application device 60 descent to terminate application in the same manner as in step ST14.

In many cases, a deviation amount of adhesive at each of positions i.e. application start position of outward travel application, application start position of homeward travel application, application termination position of outward travel application and application termination position of homeward travel application differ.

Therefore, it is preferred that the correction amounts at steps ST3, ST11, ST 13 and ST20 are different.

In the bookbinding of the above embodiments where adhesive is applied while the non-application area are being formed on the spine of the sheets, at least any one of the application start timing or application termination timing to form the non-application area is adjusted based on the thickness information of the sheet bundle.

Therefore, a fluctuation of the lengths of the non-application area formed at the end sections of the spine of the sheet bundle is suppressed, thereby a deterioration of quality of booklet caused by protrusion of adhesive, and a trouble in the bookbinding process can be preferably prevented.

Meanwhile, the present embodiments have the configuration that the application device 60 moves in the longitudinal direction along the spine SA in respect to the sheet bundle S1, however, a configuration where the sheet bundle S1 is moved is possible. Also, while the embodiments have the configuration to move the application device 60 in respect to the sheet bundle S1, a configuration where the sheet bundle ascents and descents is possible. Further, a configuration where the rotation direction of the application roller 61 is switched for the outward travel and the homeward travel is possible.

What is claimed is:

1. A bookbinding apparatus, comprising:

an application device to apply adhesive to a spine of a sheet bundle;

a first driving device configured to move the sheet bundle or the application device in a first direction, wherein the first direction is along a longitudinal direction of the spine of the sheet bundle;

a second driving device configured to move the sheet bundle or the application device in a second direction which is transverse to the first direction, wherein the second driving device moves the application device or the spine of the sheet bundle to a close state where the application device and the spine of the sheet bundle are in contact with each other or an open state wherein the application device and the spine of the sheet bundle are separate from each other;

a thickness information creation device to create thickness information of the sheet bundle; and a control device to control the first driving device and the second driving device;

wherein the control device is configured to:

control the first driving device to move the sheet bundle or the application device, while in the open state, in the first direction, control the second driving device to move the sheet bundle or the application device to the close state at an application start timing, and control the first driving device to move the sheet bundle or the application device in the first direction, while in the close state, wherein the control device controls the application start timing such that a first area on the spine of the sheet bundle with the adhesive applied is formed subsequent to a second area without the adhesive; or control the first driving device to move the sheet bundle or the application device, while in the close state, in the first direction, control the second driving device to move the sheet bundle or the application device to the open state at an application termination timing, and control the first driving device to move the sheet bundle or the application device in the first direction, while in the open state, wherein the control device controls the application termination timing such that a third area on the spine of the sheet bundle with the adhesive applied is formed proceeding to a fourth area without the adhesive, and wherein the control device adjusts either the application start timing or the application termination timing based on the thickness information of the sheet bundle created by the thickness information creation device.

2. The bookbinding apparatus of claim 1, wherein the control device delays the application start timing when the thickness information indicates that the sheet bundle is thick.

3. The bookbinding apparatus of claim 1, wherein the control device advances the application termination timing when the thickness information indicates that the sheet bundle is thick.

4. The bookbinding apparatus of claim 1, wherein the application device applies adhesive in an outward travel when the application device moves from a home position to a turn-around position, and a homeward travel when the application device moves from the turn-around position to the home position.

5. The bookbinding apparatus of claim 4, wherein the application device comprises an application roller which rotates in a same direction during the outward travel and the homeward travel to apply the adhesive, and the control device adjusts the application start timing based on the thickness information of the sheet bundle at a time of application of the adhesive in either outward or homeward travel where a moving direction of the application device with respect to the sheet bundle and a rotation direction of the application roller at an application position where the adhesive is applied on the spine of the sheet bundle coincide.

6. The bookbinding apparatus of claim 1, wherein the application device comprises an application roller to apply the adhesive by rotation, and the control device adjusts the application start timing based on the thickness information of the sheet bundle at a time of application of the adhesive when a moving direction of the application device with respect to the sheet bundle and a rotation direction of the application roller at an application position coincide.

7. The bookbinding apparatus of claim 1, wherein the application device comprises a regulation member to regulate a thickness of the adhesive applied to the spine of the sheet bundle.

8. A bookbinding system, comprising:

an image forming apparatus to form images on a plurality of sheets; and the bookbinding apparatus of claim 1 to bind the plurality of sheets received from the image forming apparatus.

* * * * *